United States Patent [19]

Sundberg

[11] 4,106,546

[45] Aug. 15, 1978

[54] METHOD FOR INDUCTIVELY STIRRING MOLTEN STEEL IN A CONTINUOUSLY CAST STEEL STRAND

[75] Inventor: Yngve Sundberg, Vesteras, Sweden

[73] Assignee: ASEA Aktiebolag, Vesteras, Sweden

[21] Appl. No.: 752,850

[22] Filed: Dec. 21, 1976

Related U.S. Application Data

[63] Continuation-in-part of Ser. No. 705,164, Jul. 14, 1976, abandoned, which is a continuation of Ser. No. 552,937, Feb. 25, 1975, abandoned.

[30] Foreign Application Priority Data

Feb. 27, 1974 [SE] Sweden ..... 7402575

[51] Int. Cl.[2] ..... B22D 27/02; B22D 11/128

[52] U.S. Cl. ..... 164/49; 164/250; 164/147

[58] Field of Search ..... 164/71, 282, 49, 50, 164/51, 251, 147, 250, 82; 226/93, 94, 189

[56] References Cited

U.S. PATENT DOCUMENTS

| | | | |
|---|---|---|---|
| 3,693,697 | 9/1972 | Tzavaras | 164/82 X |
| 3,882,923 | 5/1975 | Alberny | 164/282 X |
| 4,016,926 | 4/1977 | Yamada | 164/49 X |

*Primary Examiner*—Francis S. Husar
*Assistant Examiner*—John S. Brown
*Attorney, Agent, or Firm*—Kenyon & Kenyon, Reilly, Carr & Chapin

[57] ABSTRACT

Molten steel contained in a solidified steel skin of a continuously cast steel strand, is inductively stirred by inductive stirrers supplied with multi-phase AC having a frequency of from about 2 Hz to about 3 Hz, thereby obtaining an increased field strength or flux density in the molten steel and reducing the currents induced wastefully in the skin of solidified steel.

1 Claim, 2 Drawing Figures

METHOD FOR INDUCTIVELY STIRRING MOLTEN STEEL IN A CONTINUOUSLY CAST STEEL STRAND

This is a continuation-in-part of application Serial No. 705,164, filed July 14, 1976 and now abandoned, which is a continuation of appication Ser. No. 552,937, filed Feb. 25, 1975, now abandoned.

BACKGROUND OF THE INVENTION

In the continuous casting of steel a cast steel strand continuously leaves the casting mold with a relatively thin skin of solidified steel containing molten steel, the strand traveling through a series of rollers which support the skin on opposite sides of the strand, cooling progressively causing the skin to thicken by solidification of the molten steel until a solid steel strand is obtained.

It is desirable to stir the molten steel within the skin, for example, to prevent the formation of pipe and dentrites.

It is known that molten steel in a strand during continuous casting can be stirred by one or more stirrers comprising induction coils supplied with multi-phase AC having frequencies within the range of 10–60 Hz.

The Alberny et al. U.S. Pat. No. 3,882,923 discloses the above type of stirring, the induction coils being positioned inside of the rollers supporting the skin. This patent recomments the use of multi-phase AC having the frequencies of 10–60 Hz.

The stirring force obtained with a stirrer with a given linear current density can be shown to be proportional to the frequency if the influence of the induced current on the distribution of the magnetic field is neglected. Following this rule, the frequency should be chosen as high as possible in order to obtain as big a force as possible with a given linear current density.

However, when taking the influence of the induced currents into account when deriving a formula for stirring force, one finds that the proportionality between force and frequency is only valid up to a certain frequency. With increasing frequency the force will reach a maximum and thereafter decreases.

Another phenomenon will also be clear in such a deeper derivation: the volume force density will decrease faster with increasing perpendicular distance from the surface of the strand than a simpler derivation will indicate. This is important in the case of stirring the molten metal inside the skin of a strand during continuous casting. It is also important in a case when the induction stirrer is placed inside steel rollers with a considerable wall thickness.

SUMMARY OF THE INVENTION

In the present invention the aim is to select a suitable frequency range for the multi-phase AC supply to the induction stirrers in view of the above phenomena. The lower limit of the range is set for obtaining an acceptable stirring force with an available linear current density. The upper limit is set for obtaining moderate induced currents in the skin of the strand and in the rollers, so that a good portion of the travelling magnetic field will reach the molten metal and give acceptable stirring forces.

The frequency range is selected between $\rho/\tau^2$ and 2 $\rho/\tau^2$, where $\tau$ is the pole pitch of the stirrer in meters and $\rho$ is the resistivity of the strand in ohm mm$^2$/mm.

The pole pitch is the distance in meters between the positive and the negative maximum of the travelling magnetic flux.

In the case of a continuously cast steel strand with a width of 1,500 mm, a multi-phase AC having a frequency from about 2.4 Hz to about 4.8 Hz is within the stated limits.

BRIEF DESCRIPTION OF THE DRAWINGS

The accompanying drawings schematically illustrate the components of a continuous steel casting machine, to the extent required to illustrate the principles of the present invention, FIG. 1 in vertical section showing the continuous casting mold, the traveling steel strand and the skin-supporting stirrer rollers containing the induction coils, while

DETAILED DESCRIPTION OF THE INVENTION

Having reference to the above drawings, a continuous steel casting mold CCM is delivering a continuously traveling steel strand having a skin S and, although not illustrated, containing molten steel, the skin continuously increasing in thickness due to progressive solidification of the molten steel as the strand travels downwardly and cools with its skin supported by a series of roller pairs indicated at 11-11', 12-12' and 13-13'. There is, of course, a much longer series of these rollers. Each of the rollers shown is a stirrer roller containing inductor coils with the usual ferrous lamination yokes, the inductor coils being shown at 14 and 15 and at 14' and 15' inside of the various rollers, the rollers being, of course, made of non-magnetic metal. The rollers and their coils extend transversely with respect to the strand.

Figure 1:
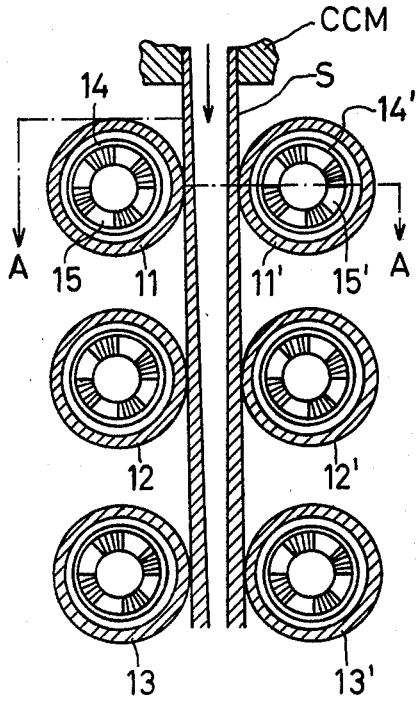
Figure 2:
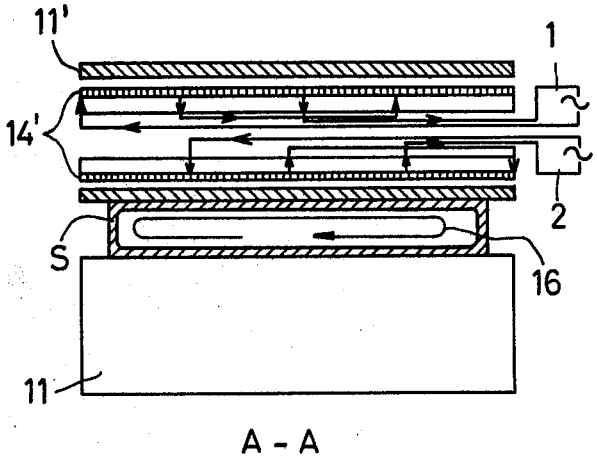
FIG. 2 shows the stirrer rollers and the strand, in cross section taken on the line A—A in FIG. 1.

Reference to FIG. 2 shows by the arrows the current direction of the different phases fed to the stirrer's induction coils from the sources 1 and 2 of multi-phase AC. This figure shows the AC phased so that the stirrers on one side give a force in a direction which is opposite to the direction of the forces obtained by the stirrers on the other side of the strand. The flow pattern of the molten steel will then be, in principle, according to the arrow 16. Other directions of stirrer forces can be selected whereby different stirring patterns can be obtained. However, particularly as the skin becomes thicker, at current frequencies generally used for inductive stirring of molten steel, more and more of the desired field strength or flux density in the molten metal itself, is lost by being carried by the skin rather than by the molten metal.

With currently conventional equipment, the use of multi-phase AC having a frequency of from $\rho/\tau^2$ to 2 $\rho/\tau^2$ Hz results in only a small amount of the flux field or current being lost in the skin. The desired inductive stirring is much greater than would ordinarily be expected when viewed in the light of the prior art knowledge of inductive stirring.

The difference in resistivity between molten steel and solid steel at 800° C, for example, is not very great. Specifically, the values are believed to be 1.36 and 1.1, respectively, this being in ohms per mm$^2$/m. The pole pitch has greater influence on the choice of frequency.

As a specific example of this invention, for a continuously cast traveling steel strand traveling from the continuous casting mold and having a typical width of 1.55 m, making the pole pitch $\tau = 0.775$ m (half the width of the strand) and using a resistivity value of 1.36, the limit $\rho/\tau^2$ comes out as 2.26 Hz. This results in very effective stirring of the molten steel inside of the steel skin of the traveling strand.

On the other hand, with a strand of the same width and using the lowest limit, 10 Hz, of the conventional stirring frequency range, it has been found that the current induced in the steel skin of the strand prevents the field from penetrating the solidified steel to any major degree.

I claim:

1. A method for inductively stirring molten steel contained in a solidifed steel skin of a travelling continuously cast steel strand by means of inductive stirrer coils supplied with multiphase a-c and which are positioned tranversely adjacent to the travelling strand, said method comprising powering said coils with multiphase a-c having a frequency between $\rho/\tau^2$ and $2\rho/\tau^2$ where $\tau$ is the pole pitch of the travelling current field in said coils and $\rho$ the electric resistivity of the strand in ohm $mm^2/mm$ said pole pitch $\tau$ selected so as to obtain a frequency between approximately 2.4 and 4.8 Hz.

* * * * *